United States Patent [19]

Montoya

[11] 4,320,851

[45] Mar. 23, 1982

[54] TRASH CAN LID HAVING SECURING MEANS

[76] Inventor: Joseph D. Montoya, P.O. Box 5834, South Lake Tahoe, Calif. 95729

[21] Appl. No.: 236,314

[22] Filed: Feb. 20, 1981

[51] Int. Cl.[3] ..... B65D 45/16; B65D 45/28

[52] U.S. Cl. ..... 220/324; 220/1 T; 220/323

[58] Field of Search ..... 220/1 T, 323, 324

[56] References Cited

U.S. PATENT DOCUMENTS

| | | | |
|---|---|---|---|
| 986,074 | 3/1911 | Madsen et al. | 220/323 |
| 1,674,962 | 6/1928 | Drake | 220/324 |
| 2,219,137 | 10/1940 | Moon | 220/324 |

*Primary Examiner*—George T. Hall

*Attorney, Agent, or Firm*—Herbert C. Schulze

[57] ABSTRACT

This invention is a trash can lid working in combination with a trash can wherein the lid is made to be easily removable, yet at the same time virtually completely non-removable by accident such as a trash can falling over or by purposeful attempts to remove the lid as by dogs, small children, and the like. This is accomplished by providing certain apertures in the lid aligned with the handles of the lid and the trasch can and providing cooperative loop arrangements affixed to the can and cooperative with the apertures, and with the utilization of draw bolt type apparatus on the lid which is easily cooperative with the loops so as to hold the can lid in place, but likewise, may be immediately withdrawn and held in a withdrawn position when not to be desired to firmly affixed.

12 Claims, 11 Drawing Figures

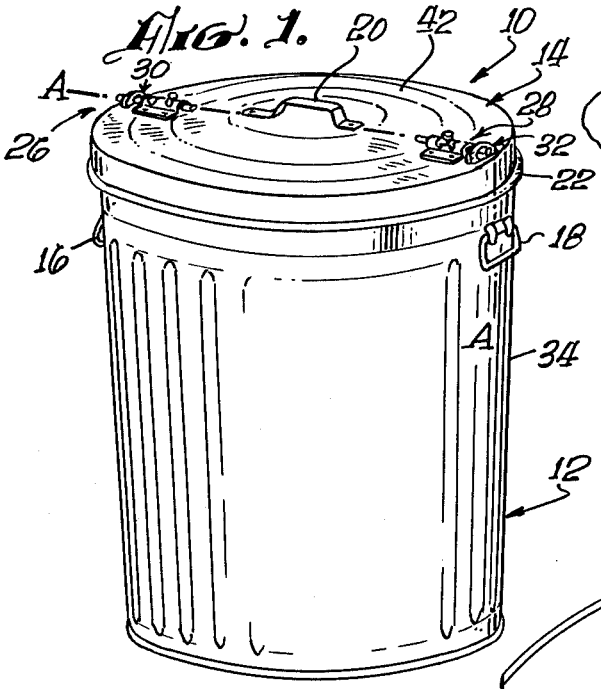
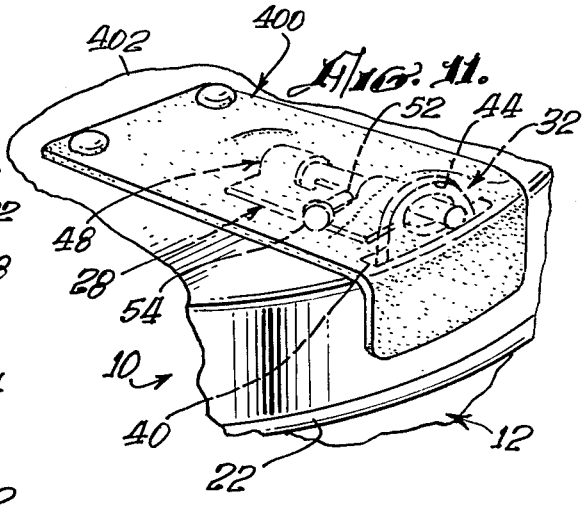
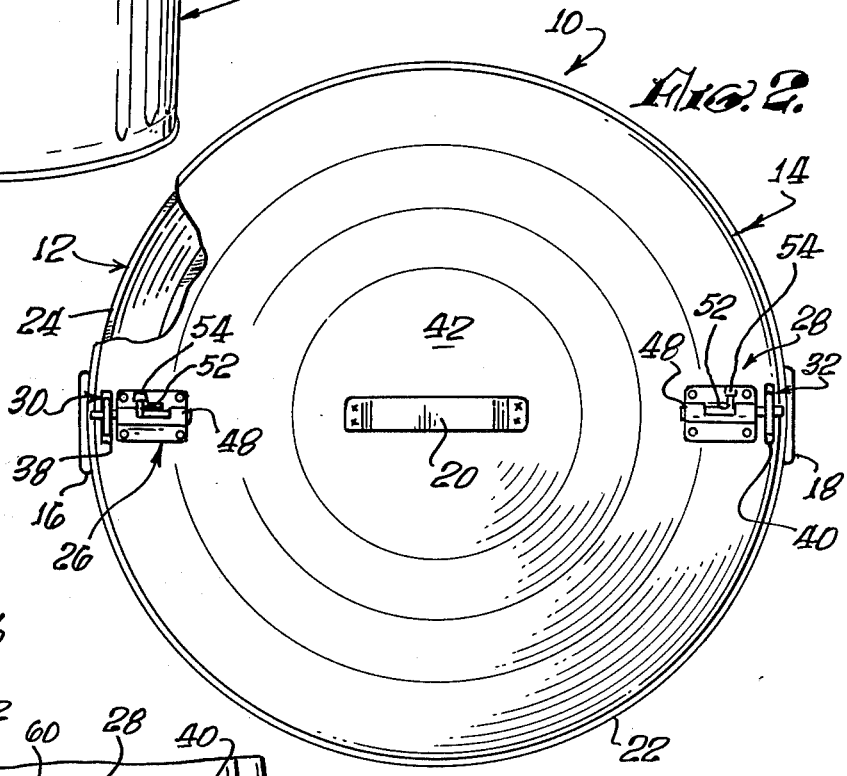
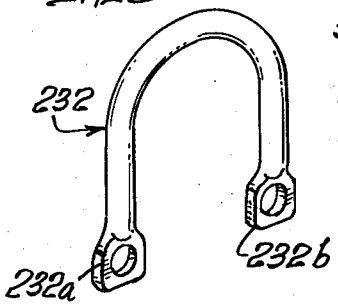
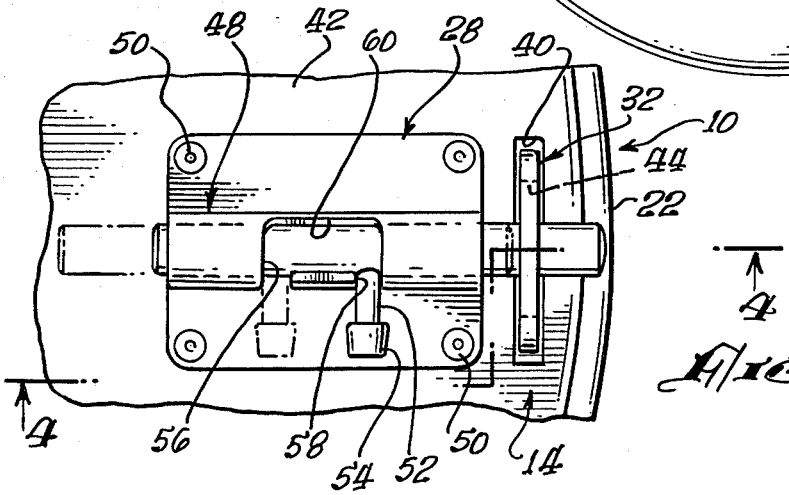
FIG. 3.

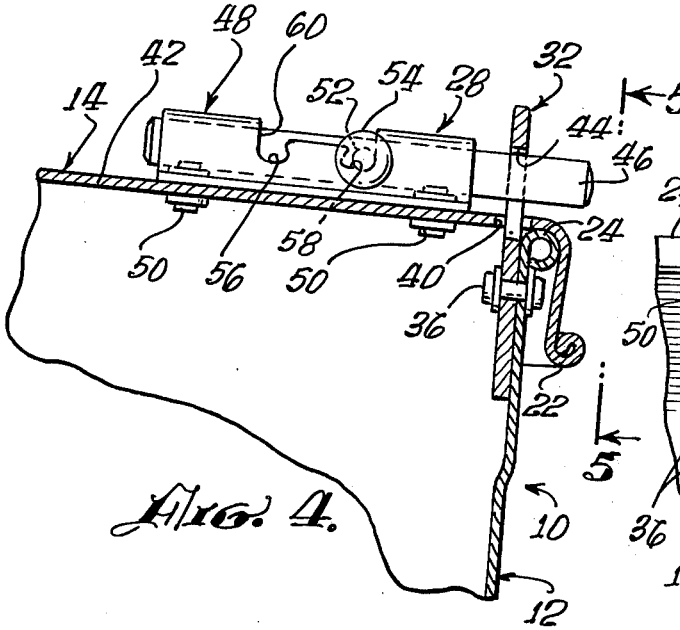
FIG. 4.
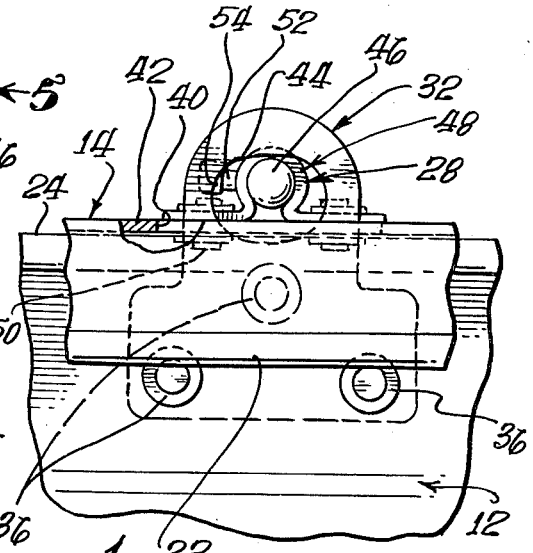
FIG. 5.
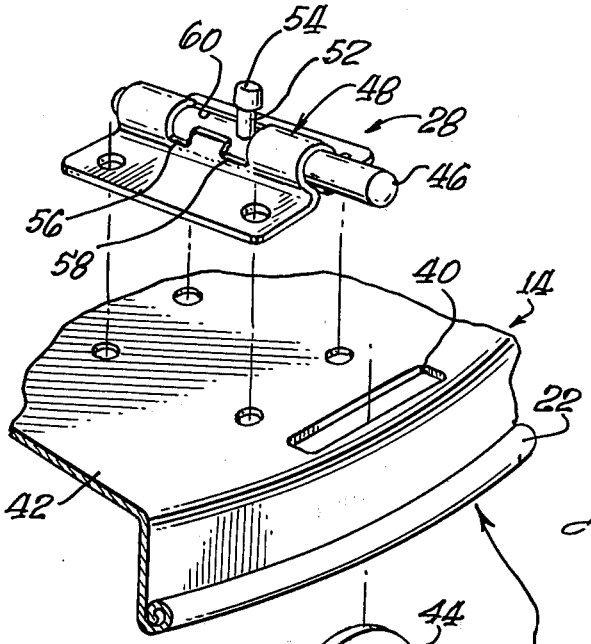
FIG. 6.
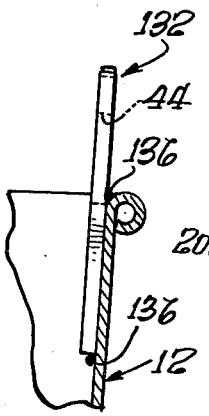
FIG. 7.
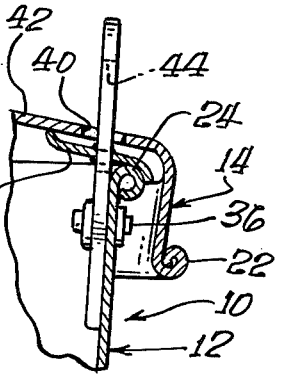
FIG. 8.
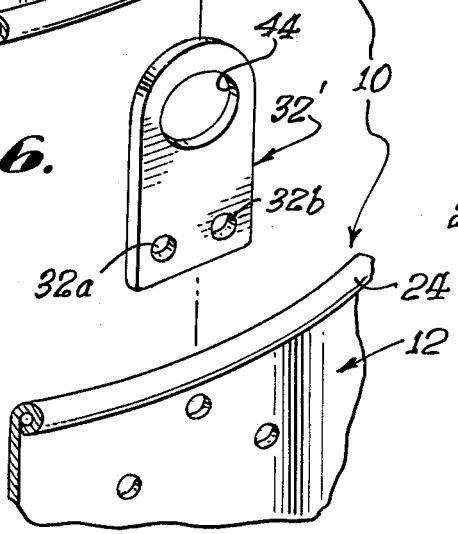
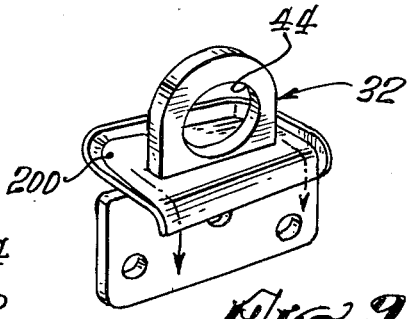
FIG. 9.

TRASH CAN LID HAVING SECURING MEANS

CROSS REFERENCE TO RELATED PATENT APPLICATIONS

There are no patent applications filed by me related to this patent application, with the exception of a Design Patent Application being filed concurrently herewith.

BACKGROUND OF THE INVENTION

1. Field of the Invention

This invention is in the general field of containers, and is more particularly directed to containers such as trash containers and garbage cans.

The invention is even more particularly directed to the lids for containers and a method and apparatus for securing lids upon such containers in such manner that the lids cannot be easily removed by accident, or by reason of interference from animals, small children, and the like.

The invention is even further directed to a method and apparatus for securing lids in place against undesired removal and at the same time making them immediately and easily removable by anyone.

2. Description of the Prior Art

The problem of undesired removal of trash can lids and the like, has existed for as long as such containers have been used. There has been much attention directed to this field, but the developments have been extremely limited and in general there are four means used to attempt to hold such lids in place.

The simplest, and probably most widely used system is to place a brick or some other weight on the lid and hope for the best; a somewhat more cumbersome but also more effective method is the use of elastic bands or ropes through the handles to tie down the lid; a difficult, but effective method is a contoured band with a clamping arrangement to surround the circumference of the lid at the top of the pail; and lastly, there have been some developments in complex clamping arrangements on the exterior of the pail and the lid. While such devices on the exterior of the pail sometimes are effective, they are cumbersome and cause problems with catching on persons clothing and considerable difficulty of removal under most circumstances.

The present invention is entirely different from any of these and comprises a simple draw bolt type of arrangement on the top of the lid cooperative with loops extending through the lid and attached to the edge of the container itself. The features of the invention are totally distinct and unique from the prior art as is its application and use.

SUMMARY OF THE INVENTION

In the field of containers, and in particular the field of trash, or garbage cans, for customary household and other uses, there have been, and there are, many difficulties with the securing of the lids so that such containers cannot be turned over and the contents emptied by animals, small children, and the like.

It is quite common to see garbage containers which have been placed outside turned over by dogs with the garbage and trash scattered upon the street or other area.

Although it might seem to be a matter of ease to affix lids to trash container so that they cannot be easily removed, the problem has not been so easy in solution.

Basically some of the problems which must be overcome are that there cannot be such a clamping or other cumbersome means of securing the lid that it interfers with the ease of removal of the lid for scavengers or trash collectors. Also, provision must be made so that any arrangement which is used may not accummulate ice in cold climates and thus become relatively impossible of removal.

Further, a final solution to this problem must incorporate means by which a person can easily, with one hand, unlatch any latching arrangement, since the other hand may be utilized for holding trash to be placed within the container.

I have studied the problem of trash can lids and have made many experiments and suffered many failures in trying to arrive at a solution to all of the problems presented.

After much thought and development effort, I have now achieved an excellent solution to the problem.

As is frequently the case, the final solution to this problem is a simple and highly effective and economical apparatus which can be used by most everyone. In connection with this I have also developed a method for affixing the apparatus to any trash can with ease.

To accomplish the desired end, I have provided a pair of openings or slots in the lid adjacent diametrically opposed edges of the lid. I then provided a pair of loops attached to the trash can lid which extends through the slots when the lid is in place. To the exterior top of the lid I have affixed a pair of simple draw bolts having provisions to be held easily in both open and closed configurations.

This apparatus is so straight forward and easy to apply that, using a kit containing the parts, anyone can modify a trash can. Additionally, the end result is an aligned pair of draw bolts holding the lid in place in perfect alignment with a lid handle and/or pail handles themselves.

It is an object of this invention to provide a method and apparatus for securing pail lids on the pails.

Another object of this invention is to provide such a method and apparatus as is mentioned wherein the lid may be easily removed by anyone, but not susceptible to removal by accident or the actions of animals or the like.

Another object of this invention is to provide such an apparatus and method that any person can quickly convert an existing trash can to the trash can and lid of the present invention.

The foregoing and other objects and advantages will become apparent to those skilled in the art upon reading the following description of a preferred embodiment in conjunction with a review of the appended drawings.

BRIEF DESCRIPTION OF THE DRAWINGS

FIG. 1 is a perspective view of the lid closing assembly of the invention;

FIG. 2 is an enlarged plan view of the device of FIG. 1;

FIG. 3 is a more detailed enlarged fragmentary top plan view of the right hand portion of FIG. 2;

FIG. 4 is a view taken on line 4—4 of FIG. 3 showing certain parts in elevation;

FIG. 5 is a view taken in the direction of arrows 5—5 of FIG. 4 and showing certain portions broken away for clarity;

FIG. 6 is an exploded perspective of the elements of the right hand portion of FIG. 2, showing a different form of a bolt receiving member;

FIG. 7 is a section similar to FIG. 4 showing an alternate embodiment of the bolt receiving member;

FIG. 8 is a sectional view similar to FIG. 4 but showing the water deflecting member added to the bolt receiving member;

FIG. 9 is a perspective of the bolt receiving member of FIG. 8;

FIG. 10 is an alternate embodiment of bolt receiving member; and

FIG. 11 is a perspective view showing a weather resistant flap placed over the locking assembly.

DESCRIPTION OF A PREFERRED EMBODIMENT

In the preferred form of the invention shown in FIGS. 1 through 5, I have indicated a standard-type trash can, preferably of the type constructed of galvanized metal. The can assembly generally indicated by the reference numeral 10 comprises a lower container portion 12 and an upper lid closure member 14. The usual carrying handles 16 and 18 are placed on the can in a conventional manner. The lid having a handle member 20 is placed upon the lower container 12 in such a manner so that a bead 22 surrounds the upper bead 24 of the lower container portion 12.

A pair of latching assemblies 26 and 28 are fastened to the upper surface of lid 14 by means of riveting, or the like. A pair of bolt receiving loop members 30 and 32 are shown fastened rigidly to the side wall 34 at the upper end of the container 12. Conventional fastening means such as rivets or nuts and bolts 36, can be employed to fasten members 30 and 32 through the wall 34.

A pair of elongated slots 38 and 40 are placed in the upper wall 42 of the lid 14. The ears 30 and 32 pass through these longitudinal slits and an enlarged opening 44 in each member 30 and 32 allows for the insertion of a sliding bolt 46. This bolt rides in a semi-cylindrical housing portion 48 of each of the latching members 26 and 28. This sliding bolt is of a bayonet-type conventional construction used in slide bolt arrangements, well known in the art. Fasteners 50 secure this housing 48 to the upper wall 42 of the lid 14. In a locked condition, the bolt 46 is moved outwardly from the center of the can through the opening 44 and then by means of a locking pin 52, having a head portion 54, the bolt can be moved from an unlocked condition as shown in phantom lines in FIG. 3 to a locked position shown in solid lines of FIG. 3.

Notches 56 and 58 are shown as extensions of opening 60 in the locking semi-circular member 48.

FIG. 6 indicates an exploded perspective of all of the components heretofore described, with the exception that enlargements 62 and 64 on the ear member 32 have been eliminated and a member 32' having openings 32*a* and 32*b* for the receipt of fastening means.

In the form shown in FIG. 7, the ear member 132 can be welded at 136 to the side walls of the upper end of the can.

FIG. 8 is a section through the ear portion of an alternate embodiment wherein a contoured flat strip 200 is welded or otherwise secured to the member 32 in such a manner as to intercept any moisture or water coming through the slot 40 and diverting it so as not to be allowed to drip into the inside of the can.

FIG. 10 shows another method of forming the bolt receiving the loop. A heavy rod or wire is bent into a configuration 232 and can have flattened ends 232*a* and 232*b* to receive fastening members through provided openings, or by weldment to the sidewall of the container 12.

FIG. 11 shows a weather flap 400 secured to the upper lid of the can 402 and provides protection for the moving parts of the latching mechanism and the receiving ear assembly against weather conditions such as rain, snow or ice.

I have found that aligning the handles 16 and 18, of the bolt assemblies 26 and 28, the ear assemblies 38 and 40, directly in line with the lift handle 20 of the lid, provides for an easy method of alignment visible to the person handling the can. This line A—A makes it easy for someone replacing the lid to be sure that it is close to being correctly aligned for the latching condition and for the purposes of easily locating the position of handles 16 and 18 when the can needs to be serviced.

Cans made of different materials than those mentioned are easily adaptable to this invention. Plastic cans are often used for the storage and disposal of trash.

While the embodiments of this invention shown and described are fully capable of achieving the objects and advantages desired, it is to be understood that such embodiments are for the sole purpose of illustration and not for the purpose of limitation.

I claim:

1. The method of removably securing container lids upon a container comprising: providing a pair of diametrically opposed openings adjacent the exterior circumference of a container lid; fixedly installing a pair of loops on the upper inner edge of the container which loops are cooperative with and extend through the diametrically opposed openings; securing a pair of draw bolts to the exterior of the lid in alignment with said loops in such manner that the draw bolts may be inserted through the loops or may be withdrawn from them, exterior of the outer surface of the lid.

2. Apparatus suitable to be installed upon a container and a container lid in order to firmly latch the container lid, removably upon the container, comprising: two rigid loops suitable to be installed, fixedly, upon the upper inner edge of a container; means to provide openings in the container lid suitable to receive and cooperate with said loops; means to provide openings within the said lid; and draw bolt means suitable to be fastened to the exterior top surface of the lid and to be insertable through the loops extending through the openings in the lid and removable therefrom.

3. The apparatus of claim 2 wherein the draw bolt means are provided with means to maintain the draw bolt in a position extending through the loops and means to maintain the draw bolt in a position where they do not extend through the loops.

4. A container comprising a receptacle having a bottom, and upstanding container sides with an upper open end; a pair of diametrically opposed loops extending above the open end of the container and affixed thereto; a lid for said container comprising a cover with a downwardly extending flange suitable to fit upon the exterior of the open end of the container, said cover being supplied with two diametrically opposed openings suitable to receive the diametrically opposed loops on the container; and a pair of draw bolts affixed to the exterior and on the top of said lid in such manner that the draw bolts may be inserted through said loops when extending through said openings in said lid.

5. The apparatus of claim 4 wherein each of said draw bolts is provided with a first means to hold the draw bolt in a position of non-insertion through said loops and a second means to hold the draw bolt in the position of insertion through said loops.

6. The apparatus of claim 5 wherein the lid is provided with a handle having a length greater than its width, and wherein the said slots and draw bolts are in alignment with the handle along its length.

7. The apparatus of claim 6 wherein the container is provided with diametrically opposed exterior mounted handles which are in alignment with said loops, draw bolts, and the length of the handle on said lid.

8. The method of removably securing a container lid onto a container which comprises: providing a pair of diametrically opposed openings adjacent the exterior circumference of a container lid; fixedly installing a pair of loops on the upper inner edge of the container, which loops are cooperative with and extend through the diametrically opposed openings; passing a securement device through said loops in such a manner that the securement device prevents the removal of said container lid from said container.

9. Apparatus for removably securing a container lid onto a container which comprises: a pair of diametrically opposed openings adjacent the exterior circumference of a container lid; a pair of loops installed on the upper inner edge of said container, which loops are cooperative with and extend through the diametrically opposed openings; securement device which can be passed through said loops in such a manner that the securement device prevents the removal of said container lid from said container.

10. The apparatus of claim 9 wherein a weather-resistant cover means is placed adjacent said securement device and of a size to be removably placed over said securement device.

11. The apparatus as set forth in claim 9 wherein said loops are manufactured from flat plates and secured to the upper inner edge of said container, said flat plates having openings at their upper ends at a location wherein a securement device can be attached through said openings when said container lid is on said container.

12. The apparatus as set forth in claim 9 wherein deflector means are fixably located on said loops so as to deflect any moisture or undesired matter passing through said diametrically opposed openings in said container lid.

* * * * *